United States Patent [19]

Pauzin

[11] Patent Number: 4,520,646

[45] Date of Patent: Jun. 4, 1985

[54] SHEET-METAL BENDING BRAKE

[76] Inventor: Alexis Pauzin, 19, montee des Soldats, Caluire (Rhone), France

[21] Appl. No.: 476,523

[22] Filed: Mar. 18, 1983

[30] Foreign Application Priority Data

Mar. 19, 1982 [FR] France ..... 82 05046

[51] Int. Cl.[3] ..... B21D 5/04

[52] U.S. Cl. ..... 72/313; 72/452

[58] Field of Search ..... 72/312–315, 72/319–322, 388, 387, 465, 452

[56] References Cited

U.S. PATENT DOCUMENTS

| | | | |
|---|---|---|---|
| 1,785,537 | 12/1930 | Stevens | 72/314 |
| 1,966,472 | 7/1934 | Way | 72/314 |
| 2,206,307 | 7/1940 | Schneider | 72/313 |
| 2,271,107 | 1/1942 | Swangren | 72/313 |
| 2,272,740 | 2/1942 | Fader, Jr. | 72/312 |
| 2,843,175 | 7/1958 | Black et al. | 72/315 |
| 4,002,049 | 1/1977 | Randolph, Sr. | 72/313 |

FOREIGN PATENT DOCUMENTS

| | | | |
|---|---|---|---|
| 58467 | 5/1978 | Japan | 72/313 |
| 551083 | 3/1977 | U.S.S.R. | 72/313 |
| 837480 | 6/1981 | U.S.S.R. | 72/314 |

*Primary Examiner*—Daniel C. Crane

*Attorney, Agent, or Firm*—Karl F. Ross; Herbert Dubno

[57] ABSTRACT

A sheet-metal bending brake has a stationary anvil having a flat and horizontal support surface bounded by and having a straight stationary bending edge and a cut-out back surface forming an acute angle with the support surface. A bending assembly displaceable perpendicular to and adjacent the anvil carries a movable bending blade having a movable bending edge parallel to the stationary edge and spaced therefrom in a direction parallel to the support surface and a clamp bar above the support surface adjacent the blade and having a clamp-bar face confronting and parallel to the support surface. This bar is supported on the bending assembly for limited vertical movement relative thereto between a lower position with the bar face below the movable edge and an upper position with the bar face above the movable edge and is normally spring-biased into the lower position. The assembly can be moved between an upper position with the bar face and the movable edge both above the support surface and a workpiece thereon and a lower position with the bar face pressing the workpiece against the support surface and the movable edge below the stationary edge and through an intermediate position with the bar face and the movable edge level with each other and both engaging the workpiece. Thus the bar clamps the workpiece to the anvil and movement from the intermediate position to the lower position of the blade bends over the workpiece edge region. When moving from the intermediate to the lower position the blade is pivoted forward to further bend the workpiece.

8 Claims, 6 Drawing Figures

SHEET-METAL BENDING BRAKE

FIELD OF THE INVENTION

The present invention relates to an apparatus or brake for bending sheet metal and the like. More particularly this invention concerns such a tool used in a machine-shop press to bend over edge regions of metal plates.

BACKGROUND OF THE INVENTION

A standard sheet-metal bending brake has a substantially stationary anvil having a flat and horizontal support surface bounded by and having a straight stationary bending edge and a side surface also bounded by the stationary bending edge and forming an acute angle with the support surface. A plate workpiece to be bent is supported on the surface with an edge region projecting horizontally beyond the stationary edge. A bending assembly displaceable perpendicular to and adjacent the anvil carries a movable bending blade having a movable bending edge parallel to the stationary edge and spaced therefrom in a direction parallel to the support surface and a clamp bar above the support surface adjacent the blade and having a clamp-bar face confronting and substantially parallel to the support surface. This bar is supported on the bending assembly for limited vertical movement relative thereto between a lower position with the bar face below the movable edge and an upper position with the bar face above the movable edge and is normally spring-biased into the lower position. A drive, normally formed by a standard bending press, displaces the assembly with the bar and the blade relative to the anvil between an upper position with the bar face and the movable edge both above the support surface and the workpiece thereon and a lower position with the bar face pressing the workpiece against the support surface and the movable edge below the stationary edge and through an intermediate position with the bar face and the movable edge level with each other and both engaging the workpiece. Thus the bar clamps the workpiece to the anvil and movement from the intermediate position to the lower position of the blade bends over the workpiece edge region.

In such a machine the normally horizontal spacing parallel to the support surface between the two edges must correspond fairly closely to the workpiece thickness for a 90° bend. Ideally the spacing is exactly equal to the workpiece thickness for a perfect such bend. For a different bend angle or thicker workpiece it is necessary to reset the machine in a laborious and complicated manner.

OBJECTS OF THE INVENTION

It is therefore an object of the present invention to provide an improved bending brake.

Another object is the provision of such a bending brake which overcomes the above-given disadvantages, that is which is capable of dealing easily with workpieces of different thickness and of producing different bend angles without complex readjustment.

A further object is the provision of such a machine which can even bend a workpiece to less than a right angle, that is which can bend the end region of a workpiece through more than a right angle, assuming the workpiece is planar to start with.

SUMMARY OF THE INVENTION

These objects are attained according to the instant invention in a sheet-metal bending brake having a substantially stationary anvil having a flat and horizontal support surface bounded by and having a straight stationary bending edge and a back surface also bounded by the stationary bending edge and forming an acute angle with the support surface. Thus a plate workpiece to be bent is supported on the surface with an edge region projecting horizontally beyond the stationary edge. A bending frame displaceable perpendicular to and adjacent the anvil carries a movable bending blade having a movable bending edge parallel to the stationary edge and pivotal on the frame about an axis parallel to the edges between a back position with the movable edge spaced parallel to the support surface from the stationary edge and a front position with the movable edge generally aligned perpendicular to the support surface with the stationary edge. This blade has a front face bounded by the movable edge and cut out and open parallel to the support surface toward the stationary edge. A clamp bar above the support surface adjacent the blade has a clamp-bar face confronting and substantially parallel to the support surface. This clamp bar is supported on the bending frame for limited vertical movement relative thereto between a lower position with the bar face below the movable edge and an upper position with the bar face above the movable edge. A drive normally constituted by a standard machine-shop bending press displaces the frame with the bar and the blade relative to the anvil between an upper position with the bar face and the movable edge both above the support surface and the workpiece thereon and a lower position with the bar face pressing the workpiece against the support surface and the movable edge below the stationary edge and through an intermediate position with the bar face and the movable edge level with each other and both engaging the workpiece. Thus the bar clamps the workpiece to the anvil and movement from the intermediate position to the lower position of the blade bends over the workpiece edge region. Further means between the blade and the frame pivots the blade from the back position in the upper and intermediate positions of the frame into the front position in the lower position of the frame. The stationary edge edge aligned with and engages into the cut-out front surface of the blade in the lower position of the frame and front position of the blade and simultaneously the movable edge engages under and forward of the stationary edge. In this manner the workpiece end region is bent through more than a right angle.

This system can bend any workpiece thinner than the horizontal spacing between the edges in the back position of the blade. The movable edge therefore can attack the plate to be bent somewhat out from the stationary edge, increasing the lever arm and thereby decreasing the force needed for the bending operation.

According to another feature of his invention the frame includes a carrier on which the blade is pivoted and on which the support means supports the clamp bar. The carrier is also displaceable relative to the frame between an upper position and a lower position. The brake further comprises biasing means between the carrier and the frame for urging the carrier into its lower position. The pivoting means includes coacting formations on the blade and frame. At least one of the formations is inclined to a perpendicular to the support surface. These formations are engageable only in the upper position of the carrier relative to the frame. The blade has a rear face turned away from the stationary edge and forming the respective formation. Thus as the carrier moves up in the frame the blade is cammed forward, an action that only takes place once the blade edge has moved down past the stationary anvil edge.

The system according to this invention has spring means between the blade and the carrier urging the blade into the back position. In addition the biasing means includes at least one single-action hydraulic cylinder braced between the carrier and the frame. For automatic operation valve means is provided for depressurizing the cylinder when the frame attains its lower position. Thus the pressure in this cylinder or these cylinders can be maintained very high to absolutely prevent forward pivoting of the blade until it has safely moved down past the anvil edge.

The cylinder in this system includes a stop limiting travel of the carrier relative to the frame. In addition biasing means is provided, in the form of at least one hydraulic cylinder braced between the frame and the clamp bar, for urging the clamp bar into its lower position relative to the frame.

DESCRIPTION OF THE DRAWING

The above and other features and advantages will become more readily apparent from the following, reference being made to the accompanying drawing in which.

SPECIFIC DESCRIPTION

Figure 2:
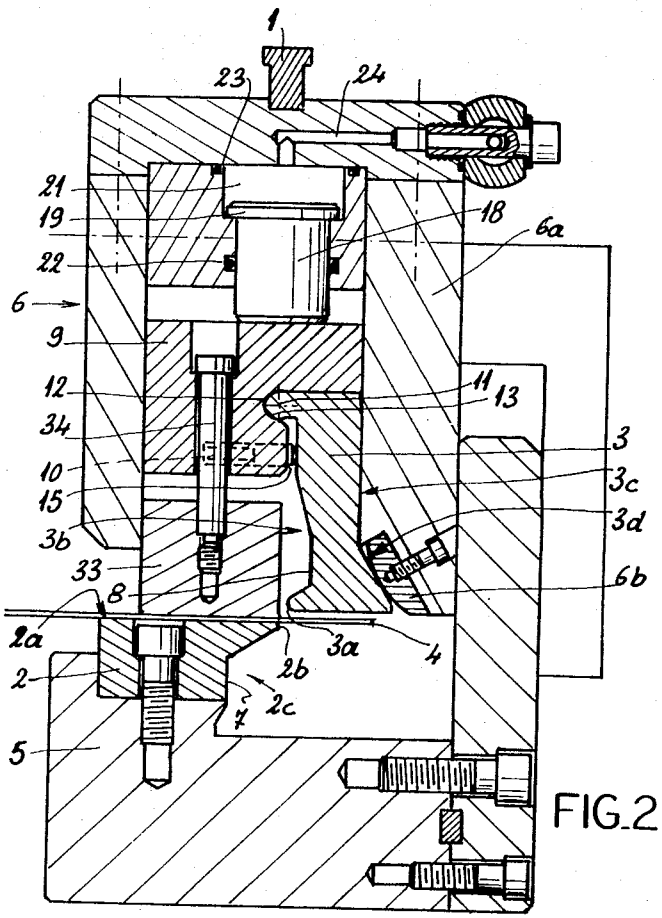
FIGS. 1, 2, 3, and 4 are vertical cross sections through the bending brake according to this invention in successive positions during a bending operation.

As seen in FIGS. 1 through 5 a bending brake according to this invention has a base 5 supporting an anvil 2 elongated in a direction perpendicular to the plane of the view and having a planar and horizontal upper surface *2a* terminating at a stationary rear edge *2b*. In addition this anvil 2 has a cut-away rear surface also bounded by the edge *2b* and forming an acute angle, here 45°, with the surface *2a*.

A vertical guide 7 extending upward from the rear edge of the base 5 supports a bending assembly 6 for vertical up and down movement perpendicular to the surface *2a* as indicated by respective arrows 16 and 17. This assembly 6 comprises an outer downwardly open U-section frame *6a* which is vertically displaced by a standard press partially indicated at 1. Vertically displaceable inside this U-section frame *6a* is a carrier body 9 in turn carrying a holddown or clamp bar 33 and a movable blade 3.

The holddown bar 33 has a bottom face *33a* parallel to and engageable with the surface *2a*, but normally engaging against a workpiece 4 lying thereon with its edge region projecting back (toward the left in the drawing) beyond the edge *2b*. A plurality of bolts or cap screws 34 extend loosely through counterbored passages 35 in the carrier block 9 and have lower ends threaded into the bar 33 and heads that can engage downward against the carrier 9.

Figure 5:
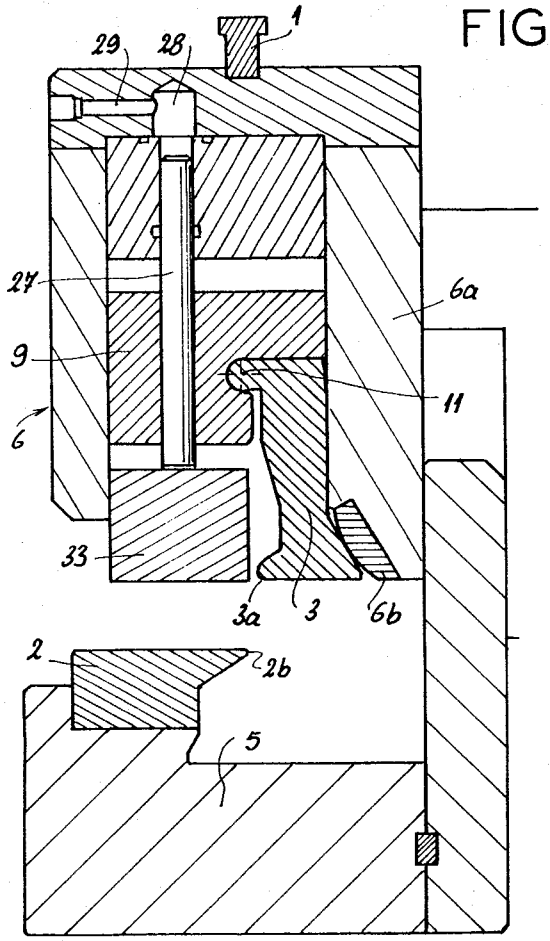
FIG. 5 is a vertical section through the brake in the position of FIG. 1 but taken along a plane offset from the plane of the view of FIGS. 1 through 4.

In addition as shown in FIG. 5 the frame *6a* is fitted with a plurality of rod pistons 27 extending through bores 36 in the carrier 9 and having lower ends bearing on the bar 33 and upper ends exposed in cylinders 28 fed via hydraulic passages 29. These passages are all connected together and are fed through a check valve 31 from a pump 37. An adjustable pressure-relief valve 32 connected to a sump 38 maintains a predetermined pressure in the cylinder 28.

Figure 1:
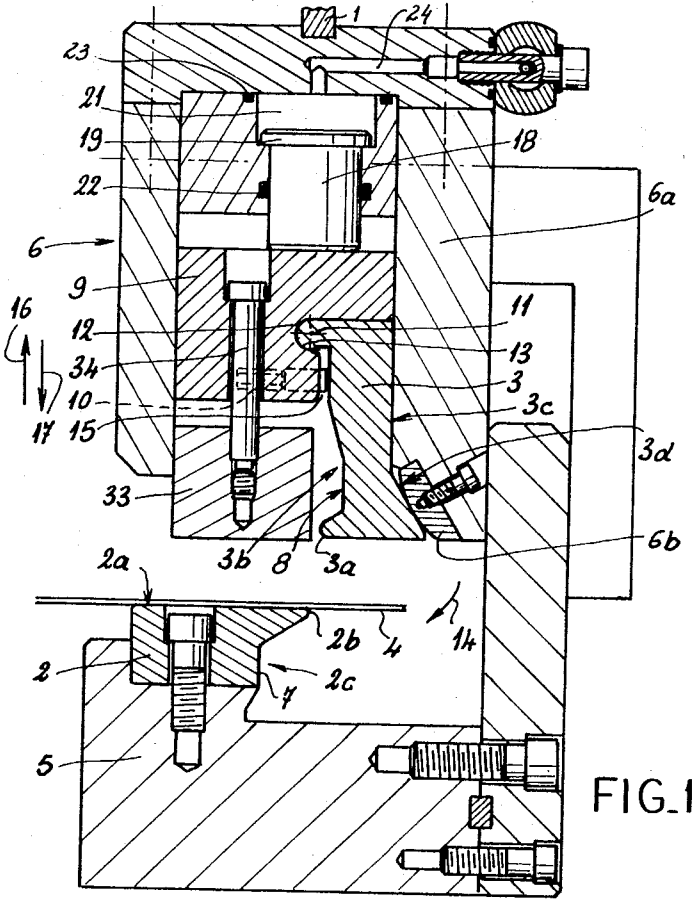
Figure 3:
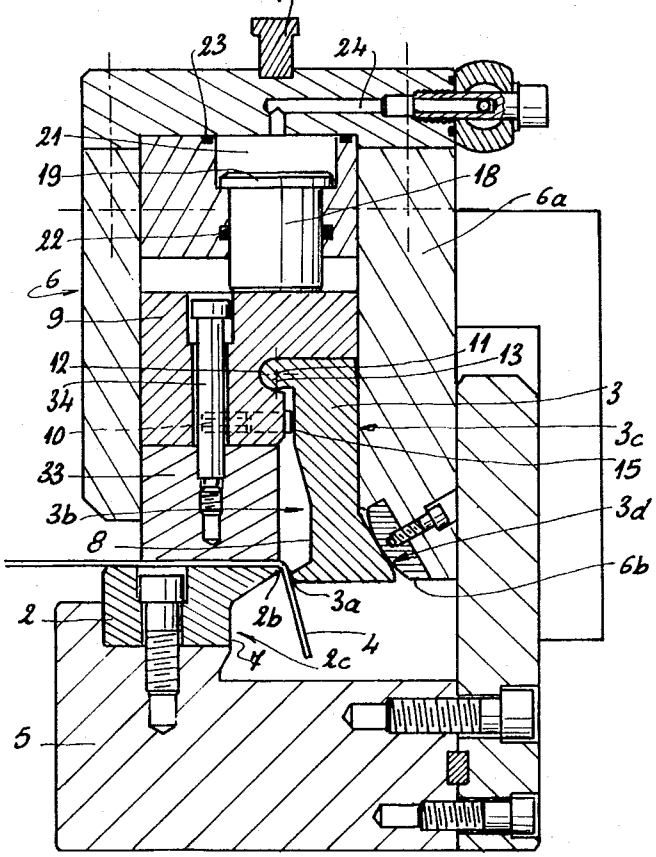
Figure 6:
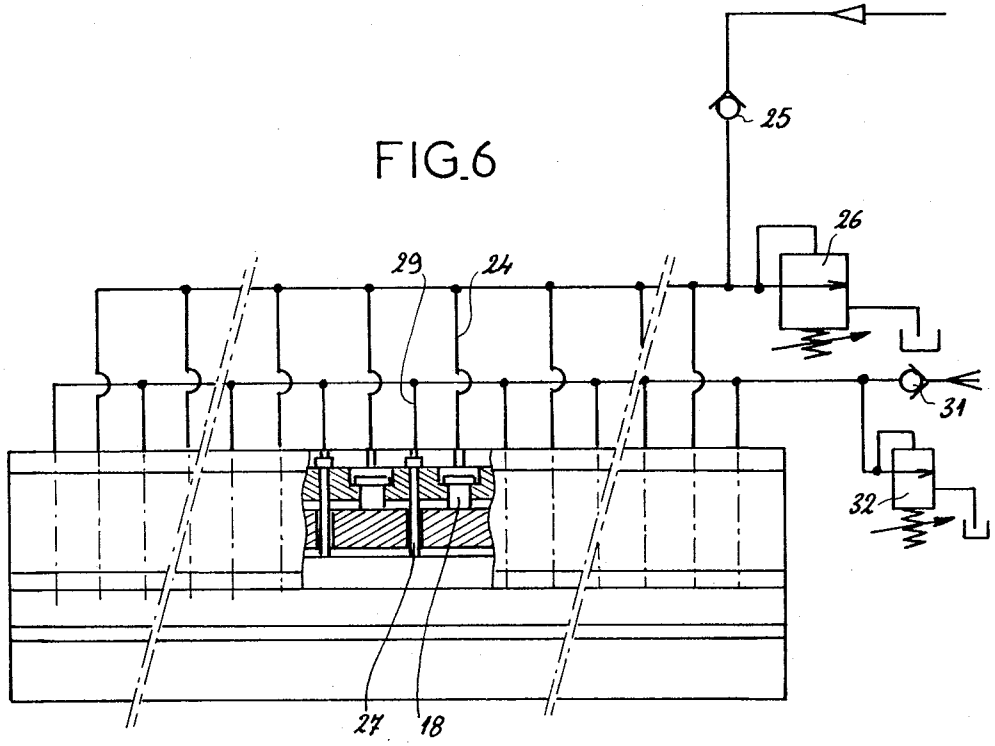
FIG. 6 is a small-scale and largely diagrammatic view illustrating the machine according to this invention.

The blade 3 has a front edge *3a* spaced a short horizontal distance s behind the edge *2b* in the position of FIGS. 1 through 3. In addition this blade 3 has a front face *3b* that has a cutout 8 terminating at the edge *3a*, a rear surface with a vertical upper portion *3c* and an inclined lower portion *3d*, and a planar lower face *3e* parallel to the surface *2a*. At the upper edge of its front face *3b* the blade 3 is formed with a forwardly projecting horizontal ridge 12 of part-cylindrical shape that is centered on a horizontal axis 11 and that is received in a complementary groove 13 formed in the carrier 9. Thus this blade 3 can pivot as indicated by arrow 14 about the axis 11 relative to the carrier 9. Springs 10 loading biasing pistons 15 urge the blade 3 into the back position of FIGS. 1 through 3 and a shoe *6b* having an inclined part-cylindrical front face engaging the surface *3d* is releasably mounted on the rear plate or flange of the frame *6a*.

A plurality of stub pistons 18 are vertically displaceable in the frame *6a*. They have lower ends bearing downward on the top of the carrier 9 and headed stop-forming upper ends 19 exposed in respective cylinders 21 made liquid-tight by seals 22 and 23 and connected to hydraulic feed lines 24. These lines 24 are all in turn continuously pressurized from the pump 37 through a check valve 25. An adjustable pressure-relief valve 26 holds the pressure in the lines 24 and cylinders 21 at a maximum, and is associated with a pilot valve 39 carried on the base 5 and engaged by the frame *6a* as will be described below to depressurize these cylinders 21.

The machine described above functions as follows:

At the start as shown in FIG. 1 the press 1 is in the fully up position. The cylinder chambers 21 and 28 are pressurized, the latter with substantially less pressure than the former, so the bar 33 is in the down position relative to the carrier 9 and the carrier 9 in turn is in the down position relative to the frame *6a*. The springs 10 hold the blade 3 in the back position with its edge *3a* spaced the distance s behind the edge *2b*.

The press 1 then moves the entire assembly 6 down until as shown in FIG. 2 the face *33a* of the bar 33 bears down against the workpiece 4 lying on the surface *2a*. In this position the surface *3e* of the blade 3 still lies above and wholly out of contact with the workpiece 4, since it is spaced above the surface *33a* by a slight distance in the lower position of same.

Further downward displacement of the frame *6a* will cause the bar 33 to move up relative to the carrier 9 and frame *6a*. Meanwhile the bar 33 will bear on the workpiece 4 with a force determined by the pressure in the cylinders 28 as established by the valve 32.

FIG. 3 shows how such further downward displacement brings the blade 3 into engagement with the projecting end region of the workpiece 4, thereby bending it down between the edges *3a* and *2b*, whose spacing s is somewhat greater than the workpiece thickness. Up to this point the blade 3 has remained in the back position.

When the FIG. 3 position is reached, however, the pilot valve 39 is tripped and the pressure is largely vented from the cylinders 21, although of course it would also be possible simply to set the pressure in these cylinders 21 at a level low enough for the press 1 to overcome. At the same time the top surface 33*b* of the bar 33 will engage the bottom surface 9*a* of the carrier 9, making further upward displacement of the bar 33 relative to this carrier 9 impossible.

Figure 4:
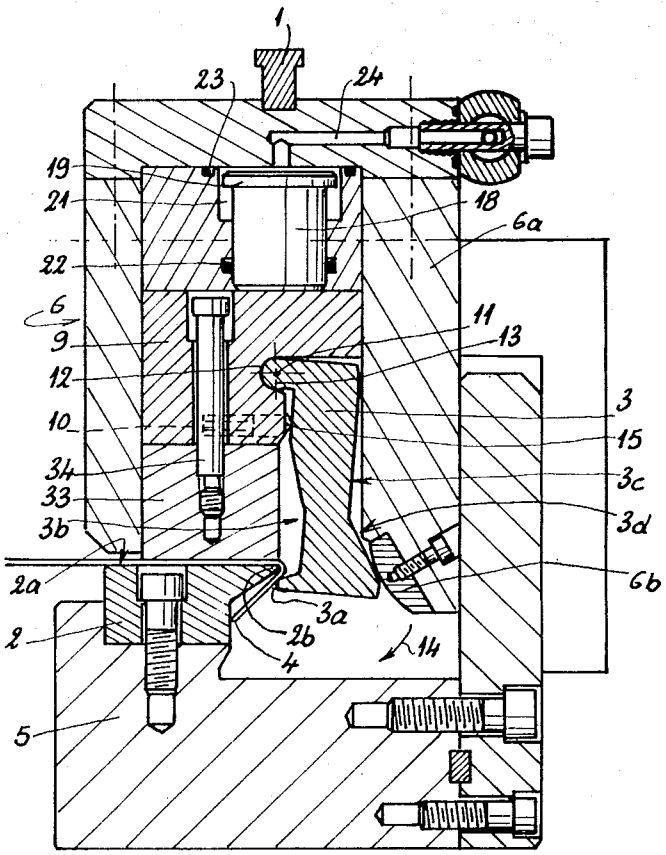

Such action will cause the carrier 9 to move up in the frame 6*a*. The inclined rear surface 3*d* of the blade 3 will slide on the shoe 6*b* and the blade 3 will be pivoted forward as shown in FIG. 4 and indicated by arrow 14. This pivoting will bend over the end of the workpiece 4 through an angle substantially greater than a right angle.

Thus the system of this invention can create virtually any bend angle, including one as small as the angle formed at the edge 2*b* between the top and back anvil faces 2*a* and 2*c*. The extent of bend is largely determined by the relative vertical positions of the assembly 6 and anvil 2 when downward displacement of the assembly 6 stops, that is in the FIG. 4 position. The further down the assembly 6 goes, the more acute will be the bend angle.

In addition the system of this invention can operate with a wide range of workpiece thicknesses without adjustment. So long as the workpiece is thinner than the spacing s, the machine can accommodate it. This is in stark distinction to the prior-art systems which required this spacing to be virtually equal to the workpiece thickness to produce a 90° bend.

I claim:

1. A sheet-metal bending brake comprising:

a substantially stationary anvil having a flat and horizontal support surface bounded by and having a straight and horizontal stationary bending edge and a back surface also bounded by and extending downward from the stationary bending edge and forming an acute angle with the support surface, whereby a plate workpiece to be bent is supported on the support surface with an edge region projecting horizontally backward beyond the stationary edge;

a bending frame displaceable vertically above the anvil;

a movable bending blade carried on the frame pivotal about a horizontal axis parallel to the bending edge and having a horizontal and movable bending edge parallel to the stationary edge, the blade being pivotal on the frame between a back position with the movable edge spaced horizontally parallel to the support surface from the stationary edge and a front position with the movable edge generally aligned vertically perpendicular to the support surface with the stationary edge, the blade having a horizontally directed front face bounded by the movable edge and formed with a cutout open horizontally parallel to the support surface toward the stationary edge;

a clamp bar above the support surface adjacent the blade and having a downwardly directed clamp-bar face vertically confronting and substantially parallel to the support surface;

means supporting the clamp bar on the bending frame for limited vertical movement relative thereto between a lower position with the bar face below the movable edge and an upper position with the bar face above the movable edge, the frame including a carrier on which the blade is pivoted and on which the support means supports the clamp bar, the carrier also being vertically displaceable relative to the frame between an upper position and a lower position;

drive means for vertically displacing the frame with the bar and the blade relative to the anvil between an upper position with the bar face and the movable edge both above the support surface and the workpiece thereon and a lower position with the bar face pressing the workpiece against the support surface and the movable edge below the stationary edge and through an intermediate position with the bar face and the movable edge level with each other and both engaging the workpiece, the front face of the blade and the back surface of the anvil at least partially horizontally confronting each other in the lower position of the blade, whereby the bar clamps the workpiece to the anvil and downward movement from the intermediate position to the lower position of the blade bends down the workpiece edge region;

means between the blade and the frame for pivoting the blade from the back position in the upper and intermediate positions of the frame into the front position in the lower position of the frame, the stationary edge being aligned with and engaging into the cutout of the front face of the blade in the lower position of the frame and front position of the blade, whereby the workpiece end region can be bent through more than a right angle; and biasing means between the carrier and the frame for urging the carrier into the respective lower position.

2. The bending brake defined in claim 1 wherein the means for pivoting includes coacting formations on the blade and frame, at least one of the formations being inclined to a perpendicular to the support surface, the formations being engageable only in the upper position of the carrier relative to the frame.

3. The bending brake defined in claim 2 wherein the blade has a rear face turned away from the stationary edge and forming the respective formation.

4. The bending brake defined in claim 2, further comprising spring means between the blade and the carrier urging the blade into the back position.

5. The bending brake defined in claim 2 wherein the biasing means includes at least one single-action hydraulic cylinder braced between the carrier and the frame.

6. The bending brake defined in claim 5, further comprising comprising valve means for depressurizing the cylinder when the frame attains its lower position.

7. The bending brake defined in claim 5 wherein the cylinder includes a stop limiting travel of the carrier relative to the frame.

8. The bending brake defined in claim 1 wherein the biasing means includes at least one hydraulic cylinder braced between the frame and the clamp bar.

* * * * *